US006745867B2

(12) United States Patent
Anthony et al.

(10) Patent No.: US 6,745,867 B2
(45) Date of Patent: Jun. 8, 2004

(54) LOUDSPEAKER DRIVE UNIT

(75) Inventors: Philip Jeffrey Anthony, Singleton Ashford (GB); Stephen Halsall, Tonbridge Wells (GB)

(73) Assignee: KH Technology Corporation, Grand Cayman (KY)

( * ) Notice: Subject to any disclaimer, the term of this patent is extended or adjusted under 35 U.S.C. 154(b) by 0 days.

(21) Appl. No.: 10/199,865

(22) Filed: Jul. 19, 2002

(65) Prior Publication Data

US 2003/0051940 A1 Mar. 20, 2003

(30) Foreign Application Priority Data

Jul. 21, 2001 (GB) ..... 0117839

(51) Int. Cl.[7] ..... G10K 13/00
(52) U.S. Cl. ..... 181/171; 181/157; 181/164
(58) Field of Search ..... 181/161, 164, 181/165, 167, 171, 172, 154–157, 148, 163, 166; 381/386, 412, 422, 392, 423, 202, 204, 205, 426–433

(56) References Cited

U.S. PATENT DOCUMENTS

| | | | | |
|---|---|---|---|---|
| 3,046,362 A | * | 7/1962 | White | 381/419 |
| 3,997,023 A | | 12/1976 | White | |
| 4,362,772 A | * | 12/1982 | Tsukagoshi et al. | 428/36.4 |
| 5,418,337 A | | 5/1995 | Schreiber | |
| 5,608,810 A | | 3/1997 | Hall | |
| 5,687,247 A | | 11/1997 | Proni | |
| 5,949,898 A | | 9/1999 | Proni | |
| 6,171,534 B1 | * | 1/2001 | Leach et al. | 264/102 |
| 6,173,065 B1 | | 1/2001 | Lin | |
| 6,332,508 B1 | * | 12/2001 | Schriever | 181/167 |
| 6,359,997 B2 | * | 3/2002 | Geisenberger et al. | 381/412 |
| 6,390,232 B1 | * | 5/2002 | Kirschbaum | 181/169 |

FOREIGN PATENT DOCUMENTS

| | | |
|---|---|---|
| GB | 1563511 | 3/1976 |
| GB | 2200515 | 1/1988 |
| GB | 2315185 | 4/1997 |
| GB | 2335821 | 3/1999 |
| GB | 2364847 | 2/2002 |

* cited by examiner

*Primary Examiner*—Rina Duda
*Assistant Examiner*—Patrick Miller
(74) *Attorney, Agent, or Firm*—Kenneth L. Sherman, Esq.; Myers Dawes Andras & Sherman, LLP

(57) ABSTRACT

A mid-frequency loudspeaker drive unit includes a substantially conical diaphragm having a forward periphery and a surround connected to and extending from the forward periphery of the diaphragm to form a substantially smooth transition from the diaphragm to the surround, the diaphragm and the surround presenting a substantially smoothly continuous outwardly facing surface. The drive unit can be part of a compound loudspeaker drive unit including a high-frequency drive unit coaxially disposed within the diaphragm and a chassis encompassing the mid-frequency drive unit with the surround being secured to the chassis to form the smooth transition from the diaphragm to the surround.

20 Claims, 1 Drawing Sheet

Fig. 1.
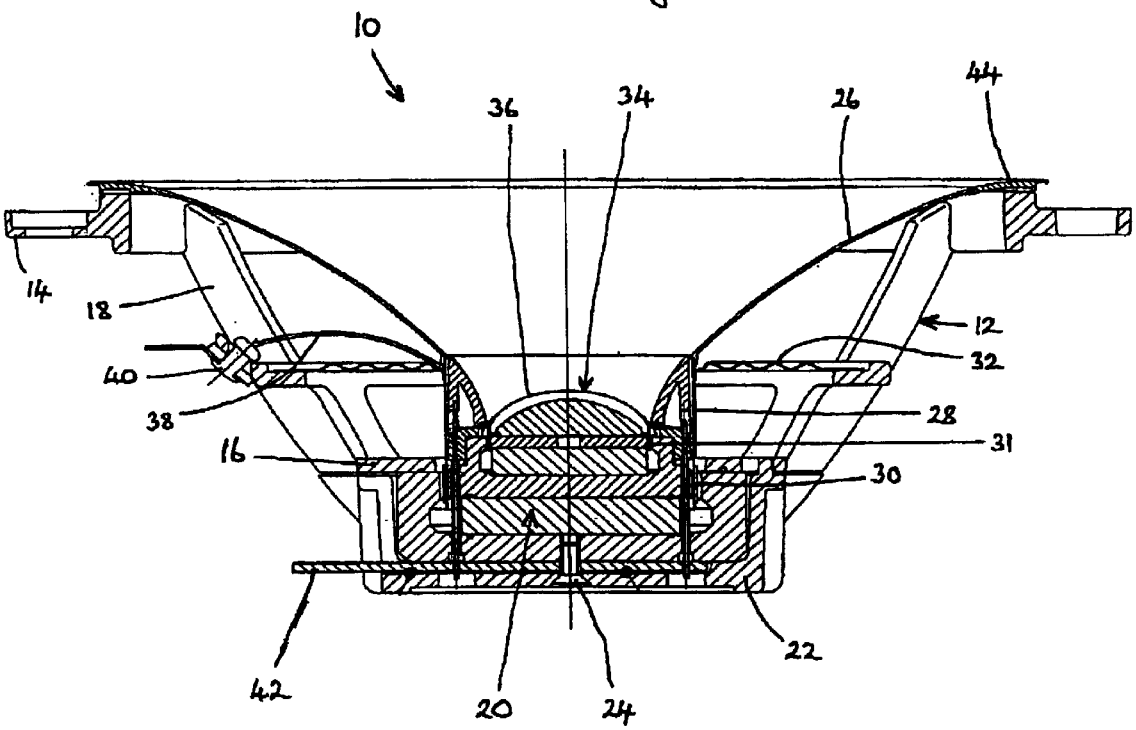
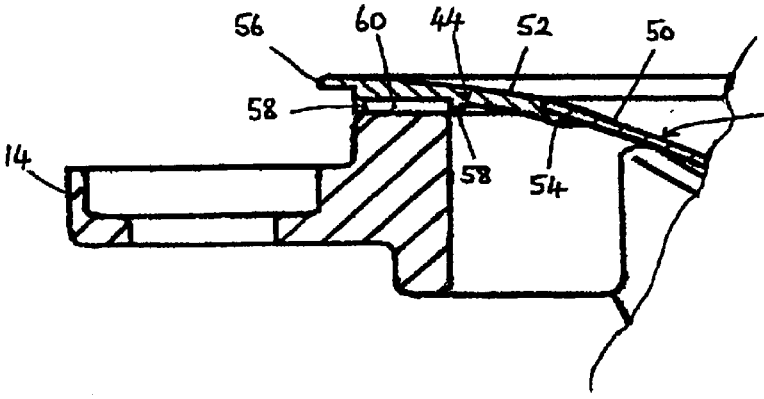
Fig. 2.

LOUDSPEAKER DRIVE UNIT

BACKGROUND OF THE INVENTION

FIELD OF THE INVENTION

The invention lies in the field of loudspeakers. The invention relates to loudspeaker drive units and is particularly concerned with compound loudspeaker drive units in which separate diaphragms are provided for reproduction of different audio frequency ranges.

British Patent No. 2,236,929, corresponding to U.S. Pat. No. 5,548,647 to Fincham, describes a compound loudspeaker drive unit including a low-frequency unit having a conical diaphragm and a high-frequency unit located in or adjacent to the neck of the low-frequency conical diaphragm such that the acoustic centers of the two units are substantially coincident. The radiation pattern or directivity of the low-frequency drive unit is determined, inter alia, by the form of the low-frequency diaphragm. With the high-frequency drive unit positioned adjacent to the neck of the low-frequency diaphragm, the form of the low-frequency diaphragm imposes its directivity upon the radiation pattern or directivity of the high-frequency unit. Consequently, at frequencies at which both drive units contribute significant sound output, both drive units have substantially similar patterns of radiation or directivity. As a result, the relative sound contributions from the two drive units as perceived by a listener are substantially unaffected by the listener being positioned at an off-axis position.

In the Fincham compound loudspeaker drive unit, the conical diaphragm of the low-frequency unit has a flexible rolled surround that is secured to the front rim of the chassis. The rolled surround constitutes a discontinuity. The use of a rolled surround, of substantially semicircular shape, has been a conventional practice for permitting the diaphragm of a low-frequency drive unit to perform the required movements. Examples of such diaphragm surrounds are to be found, for example, in U.S. Pat. No. 3,997,023 to White, U.S. Pat. No. 5,418,337 to Schreiber, U.S. Pat. No. 5,687,247 to Proni, U.S. Pat. No. 5,949,898 to Proni, and U.S. Pat. No. 6,173,065 to Lin.

The diaphragm surround plays an important part in the functioning of the loudspeaker drive unit.

In the case of a compound loudspeaker drive unit as described in Fincham, one of the problems that arises is the occurrence of diffraction from the high-frequency drive unit occurring at the roll. Such diffraction has an adverse effect on the frequency response at high frequencies. The diffraction is caused by the obstruction that the roll constitutes.

British Patent No. 2,315,185, corresponding to U.S. Pat. No. 6,219,432 to Fryer et al. (hereinafter "Fryer"), describes loudspeaker drive units that include a surround not of the conventional rolled form. Fryer discloses various configurations for the surround 4, 4A, 4B, 4C, 4D, 30, 30'. In all of the configurations, the surround has a periphery spaced apart from the periphery of the chassis 3 in an axial direction of the speaker. See Fryer at FIGS. 1 to 6, 8, and 9. Thus, the surround 4, 4A, 4B, 4C, 4D, 30, 30' has a sharp transition at the connection point to the chassis 3. Fryer is not related to a compound loudspeaker drive unit. There is a particular problem with diffraction when one has a compound loudspeaker drive unit with a high-frequency drive unit, i.e., a tweeter, positioned centrally within the diaphragm of the lower frequency drive unit.

British Patent 1,563,511 describes a diaphragm for an electro-acoustic transducer that can be used as a single speaker over an entire frequency range. This loudspeaker has a conical diaphragm 1 that sharply curves to join the supporting basket 11 at the basket's periphery through a cone support ring 12.

U.S. Pat. No. 5,608,810 to Hall discloses embodiments for woofer (low-frequency) single speaker unit or a midrange single speaker unit. In the woofer unit, a mastic band 59 connects the curved member 12 to a three-section surround 50 (52, 54, 56), which is, in turn, connected at the groove 57 of the plate 20. The curved member 12 has an angle-shaped periphery 14 that is connected to the end portion 54 of the surround 50. In the midrange unit, a mastic band 80 connects the curved member 12 to a surround 78, which is, in turn, connected at the groove 72 of the plate 70. The curved member 12 in the midrange unit, like the woofer unit, has an angle-shaped periphery 14 that is connected to the surround 78 by the mastic band 80. Thus, between the curved member 12 and the surround 50, 78 is a sharp transition.

SUMMARY OF THE INVENTION

It is accordingly an object of the invention to provide loudspeaker drive units that overcome the hereinaforementioned disadvantages of the heretofore-known devices of this general type and that reduces and, indeed, minimizes, such diffraction in a compound loudspeaker drive unit. As such, the invention produces an improved frequency response at high frequencies.

With the foregoing and other objects in view, there is provided, in accordance with the invention, a mid-frequency loudspeaker drive unit, including a substantially conical diaphragm having a forward periphery and a surround connected to and extending from the forward periphery of the diaphragm to form a substantially smooth transition from the diaphragm to the surround, the diaphragm and the surround presenting a substantially smoothly continuous outwardly facing surface. Preferably, the transition is entirely smooth and the diaphragm and the surround present an entirely smoothly continuous outwardly facing surface.

With the objects of the invention in view, there is also provided a compound loudspeaker drive unit, including a mid-frequency drive unit having a substantially conical diaphragm with a center axis and a forward periphery, and a high-frequency drive unit coaxially disposed within the diaphragm, a chassis encompassing the mid-frequency drive unit, the mid-frequency drive unit having a surround connected to and extending from the forward periphery of the diaphragm and secured to the chassis to form a substantially smooth transition from the diaphragm to the surround, the diaphragm and the surround presenting a substantially smoothly continuous outwardly facing surface.

In accordance with the invention, a compound loudspeaker drive unit includes the mid-frequency drive unit of the invention and a high-frequency drive unit where the diaphragm of the high-frequency drive unit is located centrally within the diaphragm of the mid-frequency drive unit, a flat surround having a smooth continuation of the profile of the diaphragm.

By having a smooth transition from diaphragm to surround, without any discontinuity, and with a smoothly continuous surface, the problem of diffraction from the high-frequency drive unit is minimized. It is possible to use a smoothly continuous surround for a mid-frequency diaphragm because such a diaphragm undergoes less displacement than in the case of a diaphragm of a low-frequency or bass drive unit. In practice, the compound mid-frequency/ high-frequency drive unit would be used with a dedicated bass unit in a loudspeaker cabinet.

References herein to "mid-frequency" are intended to mean frequencies in the range of approximately 300 Hz to 6 KHz for a 6-inch diameter diaphragm, with appropriate modifications of that range for diaphragms of larger or smaller dimensions.

In accordance with another feature of the invention, the diaphragm is of random copolymer polypropylene.

In accordance with a further feature of the invention, the surround is of a polypropylene elastomer.

In accordance with an added feature of the invention, the diaphragm has a given thickness and the surround has a thickness ranging between the given thickness and 125% of the given thickness.

In accordance with an additional feature of the invention, the diaphragm has a given thickness and the surround has a thickness substantially equal to the given thickness.

In accordance with yet another feature of the invention, the diaphragm has an outer edge surface having given thickness and the surround has an interior surface having a thickness substantially equal to the given thickness.

In accordance with yet a further feature of the invention, the surround has an exterior surface having a thickness greater than the given thickness.

In accordance with a concomitant feature of the invention, the surround has an exterior surface having a thickness approximately 125% of the given thickness.

Other features that are considered as characteristic for the invention are set forth in the appended claims.

Although the invention is illustrated and described herein as embodied in loudspeaker drive units, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawing.

BRIEF DESCRIPTION OF THE DRAWINGS

FIG. 1 is a cross-sectional view of a loudspeaker with a compound loudspeaker drive unit according to the preferred embodiment of the present invention.

FIG. 2 is an enlarged cross-sectional view of a portion of the compound loudspeaker drive unit shown in FIG. 1.

DESCRIPTION OF THE PREFERRED EMBODIMENTS

In order that the invention may be more fully understood, one presently preferred embodiment of a compound loudspeaker drive unit in accordance with the invention will be described by way of example and with reference to the accompanying drawing.

Referring now to FIG. 1 of the drawings, it is seen that a compound loudspeaker drive unit 10 with mid-frequency and high-frequency transducers having coaxial mid-frequency and high-frequency voice coils includes a chassis 12 in the form of a generally conical basket having a front annular rim 14 connected to a rear annular member 16 by a plurality of ribs 18. Set coaxially within the compound drive unit is a compound magnet indicated generally at 20. A heat sink 22 is disposed rearward of the compound magnet 20 and of the chassis 12. The heat sink 22 is secured to the rear of the compound magnet 20 by a screw 24.

The mid-frequency transducer or drive unit includes a diaphragm 26 of generally frusto-conical form. A tubular coil former 28 is secured to the rear edge of the diaphragm 26 and is configured to extend coaxially within an air gap in the compound magnet 20. Compound magnet 20 has two separate air gaps, one around the mid frequency voice coil 30, and the other around the high frequency cylindrical coil 31 secured to the dome 36.

The coil former 28 carries a voice coil 30 that is positioned on the former 28 such that the coil extends through the air gap. A suspension member 32 is secured between the coil former 28 and the chassis 12 to ensure that the coil former 28 and the voice coil 30 are maintained concentric with respect to the poles of the magnetic structure.

The high-frequency transducer or drive unit, indicated generally at 34, includes a dome-shaped diaphragm 36. Secured to the diaphragm 36 is a cylindrical high frequency voice coil 31 that extends through the air gap between the poles of the magnetic structure. The high-frequency unit is centralized relative to the mid-frequency unit. The high-frequency unit is coaxial with and does not interfere with motion of the mid-frequency voice coil 30.

Connections to the mid-frequency voice coil 30 are provided by flexible lead out conductors 38 extending to external connectors 40. Connections to the high-frequency voice coil are provided by way of a PCB tag panel 42.

The mid-frequency diaphragm 26 is provided with a peripheral surround 44 that is secured to the annular rim 14 of the chassis 12, for example, by adhesive. In contrast to the rolled surround of Fincham (British Patent No. 2,236,929), for example, the surround 44 of the invention is flat, so as to provide a smoothly continuous, outward-facing surface with no distinct transition between the surface of the diaphragm 26 and the surface of the surround 44. There is, therefore, no discontinuity that can give rise to diffraction from the high-frequency drive unit 34.

Although not illustrated in the drawings, a trim ring is fitted to the outwardly facing surface of the annular rim 14, with the axially outwardly facing flat surface of the trim ring being continuous with the outer edge of the surround 44. The trim ring is secured in an appropriate way to the rim 14.

The mid-frequency diaphragm 26 is preferably injection molded, for example, from random copolymer polypropylene. The surround 44 is preferably a polypropylene elastomer. The diaphragm 26 and surround 44 can be made in a one-step or two-step process to form a unitary structure. Because the surround 44 has to be able to bend and stretch, it is made of a relatively soft material. The surround 44 also preferably has damping properties to terminate the vibrations of the diaphragm 26. Therefore, the surround 44 is lossy.

As can be seen clearly from FIG. 2, the surround 44 and diaphragm 26 are overmoulded so that the two components overlap one another on the inwardly facing side of the unit. The periphery of the diaphragm is effectively recessed into the surround 44. Thus, on the outwardly facing side there is a continuous, smooth transition from the outer surface 50 of the diaphragm to the outer surface 52 of the surround. There is shown a slight bulge 54 in the surround where it overlaps the diaphragm on the inside face. The thickness of the surround at this junction zone can thus be up to approximately 125% of the thickness of the diaphragm alone, or alternatively approximately the thickness of the diaphragm.

The surround 44 is shown as increasing in thickness in the direction radially outwardly of the diaphragm, terminating at the outer edge in a thin lip which overlies the trim ring 56. On the inwardly facing side the surround has two circumferential ribs 58 which define a channel 60 therebetween for the adhesive which secures the surround to the annular rim 14.

The mid-frequency diaphragm 26 shown in the drawing is of generally conical form having an angle of flare that increases from the neck of the diaphragm towards the outer periphery of the diaphragm. However, it is to be appreciated that the diaphragm may alternatively be of conical form having a uniform angle of flare. It may be of circular, elliptical, or other section as desired.

We claim:

1. A mid-frequency loudspeaker drive unit, comprising:

a substantially conical diaphragm having a forward periphery; and a surround connected to and extending from said forward periphery of said diaphragm to form a substantially smooth transition from said diaphragm to said surround, said diaphragm and said surround presenting a substantially smoothly continuous outwardly facing surface, said surround and said diaphragm, together substantially in the shape of a single continuous curve.

2. The drive unit according to claim 1, wherein said diaphragm is of random copolymer polypropylene.

3. The drive unit according to claim 1, wherein said surround is of a polypropylene elastomer.

4. The drive unit according to claim 1, wherein:

said diaphragm is of random copolymer polypropylene; and said surround is of a polypropylene elastomer.

5. The drive unit according to claim 1, wherein:

said diaphragm has a given thickness; and said surround has a thickness ranging between said given thickness and 125% of said given thickness.

6. A drive unit according to claim 1, wherein:

said diaphragm has a given thickness; and said surround has a thickness substantially equal to said given thickness.

7. The drive unit according to claim 1, wherein:

said diaphragm has an outer edge surface having given thickness; and said surround has an interior surface having a thickness substantially equal to said given thickness.

8. The drive unit according to claim 1, wherein said surround has an exterior surface having a thickness greater than said given thickness.

9. The drive unit according to claim 8, wherein said surround has an exterior surface having a thickness approximately 125% of said given thickness.

10. The drive unit according to claim 1, wherein said single continuous curve is further a gradual curve.

11. A compound loudspeaker drive unit, comprising:

a mid-frequency drive unit having a substantially conical diaphragm with:

a center axis; and a forward periphery;

a high-frequency drive unit coaxially disposed within said diaphragm;

a chassis encompassing said mid-frequency drive unit; and said mid-frequency drive unit having a surround:

connected to and extending from said forward periphery of said diaphragm; and secured to said chassis to form a substantially smooth transition from said diaphragm to said surround, said diaphragm and said surround presenting a substantially smoothly continuous outwardly facing surface, said surround and said diaphragm, together substantially in the shape of a single continuous curve.

12. The drive unit according to claim 11, wherein said diaphragm is of random copolymer polypropylene.

13. The drive unit according to claim 11, wherein said surround is of a polypropylene elastomer.

14. The drive unit according to claim 11, wherein:

said diaphragm is of random copolymer polypropylene; and said surround is of a polypropylene elastomer.

15. The drive unit according to claim 11, wherein:

said diaphragm has a given thickness; and said surround has a thickness ranging between said given thickness and 125% of said given thickness.

16. The drive unit according to claim 11, wherein:

said diaphragm has a given thickness; and said surround has a thickness substantially equal to said given thickness.

17. The drive unit according to claim 11, wherein:

said diaphragm has an outer edge surface having given thickness; and said surround has an interior surface having a thickness substantially equal to said given thickness.

18. The drive unit according to claim 11, wherein said surround has an exterior surface having a thickness greater than said given thickness.

19. The drive unit according to claim 18, wherein said surround has an exterior surface having a thickness approximately 125% of said given thickness.

20. The drive unit according to claim 11, wherein said single continuous curve is further a gradual curve.

* * * * *